US008718526B2

(12) United States Patent
Wu et al.

(10) Patent No.: US 8,718,526 B2
(45) Date of Patent: May 6, 2014

(54) HIGH FUSING PERFORMANCE EXTERNALLY HEATED FUSER ROLLER

(75) Inventors: Fangsheng Wu, Lexington, KY (US); Scott Shiaoshin Wu, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 128 days.

(21) Appl. No.: 13/149,771

(22) Filed: May 31, 2011

(65) Prior Publication Data

US 2012/0308281 A1 Dec. 6, 2012

(51) Int. Cl.
*G03G 15/20* (2006.01)

(52) U.S. Cl.
USPC ..... 399/333; 399/122; 399/328

(58) Field of Classification Search
USPC ..... 399/122, 328, 330–333
See application file for complete search history.

(56) References Cited

U.S. PATENT DOCUMENTS

2008/0273904 A1* 11/2008 Nishida et al. ..... 399/333

* cited by examiner

*Primary Examiner* — Walter L Lindsay, Jr.
*Assistant Examiner* — Jessica L Eley

(57) ABSTRACT

An externally heated fuser roller to achieve good fusing performance, long life and relatively quick warm-up time. The fuser roller is made up of a metal core, an insulation elastic layer, a heat transport layer and optionally a release layer such that the thickness of the heat transport layer is in the range of about 0.25 and about 1 mm, the effusivity value of the heat transport layer be equal to or greater than about 800 W√s ($m^2K$), the total thermal capacity of the heat transport layer is less than about 200 J/m K, and the effusivity value of the insulation elastic layer is less than about 400 W√s($m^2K$).

19 Claims, 4 Drawing Sheets

HIGH FUSING PERFORMANCE EXTERNALLY HEATED FUSER ROLLER

BACKGROUND

1. Field of the Invention

The present invention relates to an improved externally heated fuser roller that can achieve fast warm-up time and high print quality.

2. Description of the Related Art

An image forming apparatus, such as an electrographic device, ink printer, copier, fax, all-in-one device or multi-functional device, normally uses a developing agent, such as toner or ink, that is deposited on media to form an image. The developing agent is fixed to the media using an image fixing device by applying heat and pressure. The image fixing device includes a heating device, such as a fuser. The image fixing device also includes a nip through which the media is passed. The nip is formed by the heating device and an opposing pressure roller or a back-up device. A belt or film may also be in close proximity to the heating device to aid the transport of media through the fixing device nip.

Most fusers used in electrographic machines are internally heated. These fusers usually have a metal core, one or more layers of elastomer on the metal core, and an outside top coat for toner release. Also a heating element is present inside the metal core to supply heat to the fuser. For these kinds of fusers, two fuser parameters conflict each other. A fast thermal response time generally requires the metal core to be relatively thin, with very thin or, if possible, no elastomeric layer. However, the lack of an elastomeric layer conflicts with having acceptable toner release. Good print release ability generally requires a thick layer of elastomer so that a favorable nip geometry can be formed.

For externally heated fusers, the heat source is outside the fuser and the fuser surface is heated directly. The thickness of the elastomeric layer does not affect the thermal response time as much when compared to the internally heated fuser. Therefore, with externally heated fusers, one can achieve relatively shorter thermal response times and still have good print release ability. However, none of the externally heated fusers are able to warm-up in 30 seconds or less. One of the recent trends is that the fuser has a short warm-up time from room temperature to working temperature, so that the first copy time could be less than 30 seconds or even in the range of 10 to 20 seconds. Mini belt (or film) fusers with ceramic heater designs can achieve this. But this design also has sliding contact between the belt and the ceramic heater and has little or no elastomeric layer on the belt. This limit on the fuser life and print quality can also affect reliability.

Given the foregoing, it would be desirable therefore to provide an improved externally heated fuser roller that can achieve a fast warm-up time and have high print quality.

SUMMARY OF THE INVENTION

Embodiments of the present disclosure overcome shortcomings of prior externally heated fusers thereby ensuring a fuser with a fast warm-up time and good fusing performance. According to an exemplary embodiment of the present disclosure, there is provided a fuser member for fusing toner onto a substrate in contact with an external heater for applying heat to the fuser member, the fuser member including a core member comprising a rigid outer surface, a heat insulation layer, a heat transport layer, and optionally a release layer, wherein the external heater is in contact with an outside surface of the fuser member, the heat transport layer having a thickness of about 0.25 to about 1 mm and a total thermal capacity of about 1 to about 200 J/mK, and the heat insulation layer having an effusivity value from about 1 to about 500 $W\sqrt{s}/(m^2K)$.

In some embodiments, the heat transport layer has an effusivity value between about 800 and about 5000 $W\sqrt{s}/(m^2K)$.

In yet another aspect, an image fixing apparatus for fixing a developed image on a recording medium is disclosed that includes a fuser roller, and a pressure device that contacts the fuser roller and forms a fixing nip portion therebetween, the fuser roller comprising a rigid metal core member, a heat insulation layer, a heat transport layer, and optionally a release layer, wherein the heat transport layer has a thickness ranging from about 0.25 to about 1 mm and a total thermal capacity ranging from about 1 to about 200 J/mK, and the heat insulation layer having an effusivity value of about 1 to about 500 $W\sqrt{s}/(m^2K)$.

In yet another aspect, a fuser member and an external heater in combination for fusing toner onto a substrate is disclosed, the fuser member includes a rigid outer surface, a heat insulation layer, a heat transport layer and optionally a release layer, wherein the external heater is in contact with an outside surface of the fuser member, the heat transport layer has a thickness of about 0.25 to about 1 mm and a total thermal capacity of about 1 to about 200 J/mK, and the heat insulation layer has an effusivity value from about 1 to about 500 $W\sqrt{s}/(m^2K)$.

BRIEF DESCRIPTION OF THE DRAWINGS

The above-mentioned and other features and advantages of the various embodiments of the invention, and the manner of attaining them, will become more apparent and will be better understood by reference to the accompanying drawings, wherein.

DETAILED DESCRIPTION

Figure 1:
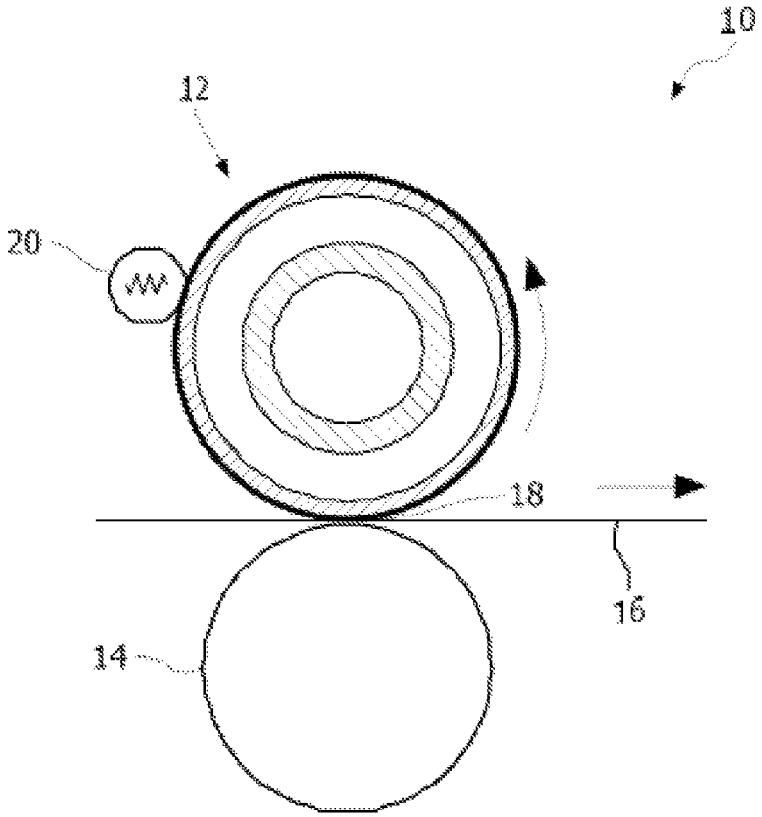
FIG. 1 is a cross-sectional view of one embodiment of a fusing unit including an externally heated fuser member according to an exemplary embodiment.

It is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted,"

and variations thereof are used broadly and encompass direct and indirect connections, couplings and mountings. In addition, the terms "connected" and "coupled" and variations thereof are not restricted to physical or mechanical connections or couplings.

Reference will now be made in detail to the exemplary embodiment(s) of the present disclosure, as illustrated in the accompanying drawings. Whenever possible, the same reference numerals will be used throughout the drawings to refer to the same or like parts.

FIG. 1 illustrates a cross-sectional side view of a fuser unit 10 of an image forming device, such as a laser printer (not shown), including a fuser member 12 and a backup member 14. The fuser member 12 fuses and/or fixes toner to a substrate 16, e.g., paper, transparencies, etc., as the substrate 16 is fed between the backup member 14 and fuser member 12, the junction of which creates a fusing nip area 18. The fuser member 12 is externally heated by an external heater 20. The external heater 20 can be a heated roller, a belt heater, a radiation heater or other heater known in the art. The fuser member 12 may include belts or rolls, or other suitable configurations known to one of ordinary skill in the art, which are utilized in fuser units of devices, such as printers and copiers.

Figure 2:
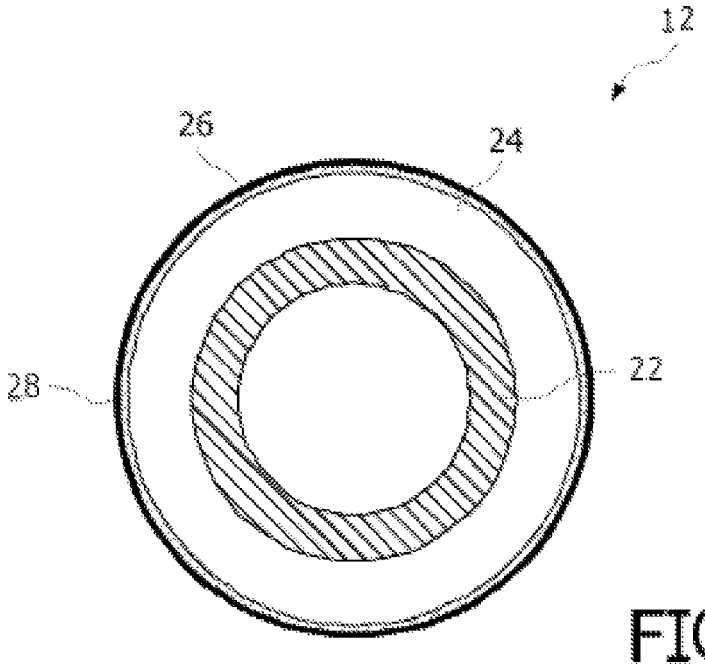
FIG. 2 is a cross-sectional view of the externally heated fuser member of FIG. 1.

FIG. 2 illustrates a cross-sectional side view of the fuser member 12. The fuser member 12 includes a rigid core member 22, a heat insulation elastic layer 24 surrounding in cross-section core member 22, and a heat transport layer 26 surrounding in cross-section heat insulation elastic layer 24. The fuser member 12 may also optionally include an additional layer 28, such as a release layer, which surrounds in cross-section heat transport layer 26. The rigid core member 22 may be made of a thermally conductive material. The thermally conductive material may be a metal or metal composition, such as aluminum or iron, or a rigid material such as ceramic, and provides strength to the fuser member 12. The rigid core member 22 is insulated from the surface of the fuser member 12 by the heat insulation elastic layer 24. The heat insulation elastic layer 24 may be constructed of a 'micro balloon' foam rubber. The heat insulation elastic layer 24 also provides proper softness to the fuser member 12 so as to form a favorable nip shape for good release and good print quality and also insulates the fuser member 12 to keep heat on the outer surface thereof. The heat transport layer 26 may be made of a relatively high thermal conductivity rubber in order to effectively receive heat from the external heater 20 and release heat. The optional release layer 28 may be a fluorinated polymer release layer, such as a perfluoroalkoxy copolymer (PFA) sleeve or a polytetrafluoroethylene (PTFE) spray coating layer, which helps the toner to separate from fuser surface after it passes through the fusing nip area 18.

Since the normal fusing dwell time, which is the time period needed for any location on a sheet of paper to pass from fuser nip entry to nip exit and thereby be subjected to heat and pressure, is about 20 to about 60 milliseconds, heat can only penetrate a small thickness of the heat transport layer 26. Thus, even though a thicker heat transport layer 26 guarantees good fusing performance, extra thickness of the heat transport layer 26 can adversely affect the warm-up time.

With simulation experiments, the effects of two parameters of the heat transport layer 26 and the heat insulation elastic layer 24 were examined. A range of parameters for fusing performance and warm-up time of the fuser roller were used.

The experiment simulated a fusing process using the structure shown in FIGS. 1 and 2 together and the structure properties shown in Table 1 were observed to determine the effect of thickness of the heat transport layer (HT) 26 on fusing performance. The properties of the heat transport layer 26 measured in the simulation include thickness (mm), thermal conductivity k (W/m K), and thermal effusivity E ($W\sqrt{s}/(m^2K)$). Thermal effusivity E is determined by the equation $E=\sqrt{k*\rho*C_p}$, where k is the thermal conductivity (W/m K), ρ is the density ($kg/m^3$), and $C_p$ is the specific heat (J/kg K).

To determine the most effective thicknesses of heat transport layer 26, toner and an uncoated 90 $g/m^2$ paper were used in the experiment. The fuser dwell time was 40 milliseconds. The toner temperature at the toner/paper interface was measured. The results are shown in the following tables and their corresponding graphs.

Figure 3:
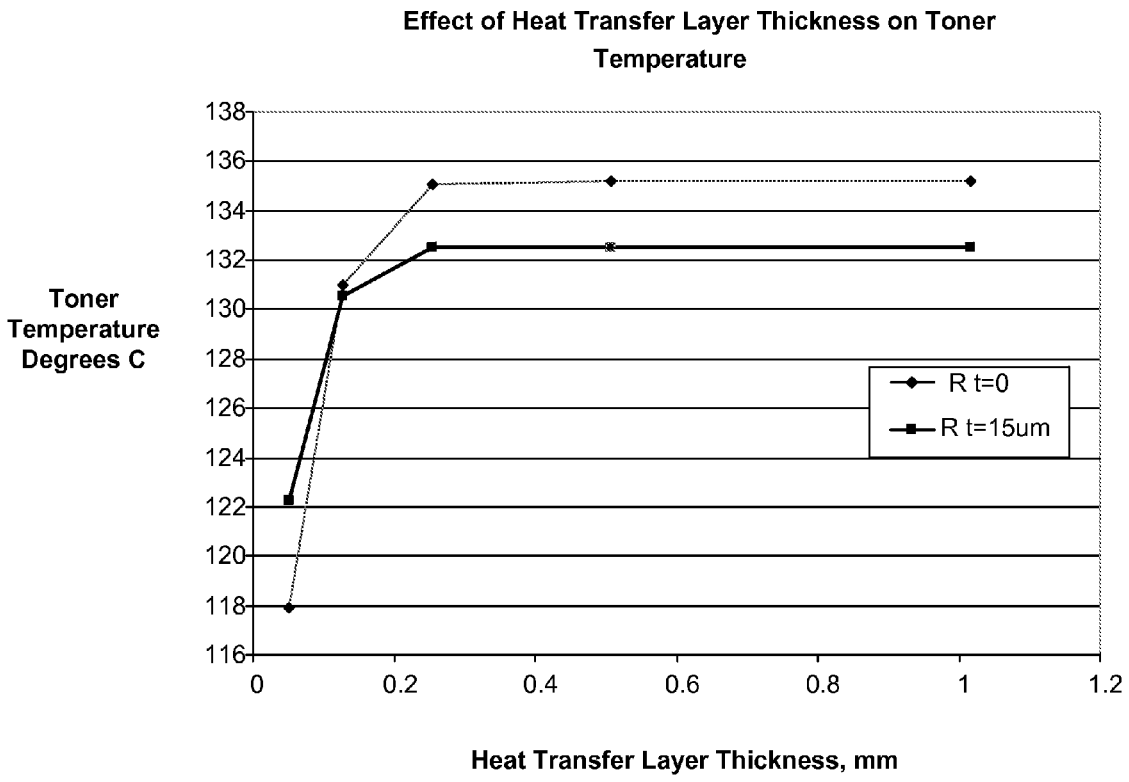
FIG. 3 is a graph illustrating a relationship between heat transfer layer thickness (HT thickness) and its effect on toner temperature for the fuser member of FIG. 1 according to an exemplary embodiment.

Based on the results in Table 1 and graphed in FIG. 3, a chosen thickness of heat transport layer 26 is identified by a substantially constant toner temperature. In the table, "R Thickness" is the thickness of the release layer 28 in mm, "HT Thickness" is the thickness of the heat transport layer 26 in mm, "HT k" is the thermal conductivity of the heat transport layer 26, and "HT E" is the effusivity value of the heat transport layer 26. In FIG. 3, one line represents the thickness of the release layer 28 being zero and the other line represents the thickness of the release layer being about 0.015 mm. From the graph in FIG. 3, it can be seen that with or without the release layer, the thickness of the heat transport layer 26 is chosen in the range of about 0.25 to about 0.5 mm as the toner temperature remains substantially constant at that heat transport layer thickness.

TABLE 1

| R Thickness (mm) | HT Thickness (mm) | HT k, (W/m K) | HT E, $W\sqrt{s}/(m^2 K)$ | Toner Temperature, (C.) |
|---|---|---|---|---|
| 0 | 0.051 | 0.6899 | 1095.4 | 117.89 |
| 0 | 0.127 | 0.6899 | 1095.4 | 130.99 |
| 0 | 0.254 | 0.6899 | 1095.4 | 135.08 |
| 0 | 0.508 | 0.6899 | 1095.4 | 135.19 |
| 0 | 1.016 | 0.6899 | 1095.4 | 135.19 |
| 0.0152 | 0.051 | 0.6899 | 1095.4 | 122.24 |
| 0.0152 | 0.127 | 0.6899 | 1095.4 | 130.57 |
| 0.0152 | 0.254 | 0.6899 | 1095.4 | 132.51 |
| 0.0152 | 0.508 | 0.6899 | 1095.4 | 132.54 |
| 0.0152 | 1.016 | 0.6899 | 1095.4 | 132.54 |

After determining the thickness of the heat transport layer 26, the effect of effusivity value of the heat transport layer on the toner and fusing performance was then determined. The effusivity E of the heat transport layer 26 is a parameter that is used for defining the fusing performance. The effusivity E of the heat transport layer 26 was determined based on varying the thermal conductivity k and thermal capacity TC of the heat transport layer 26. To determine an acceptable effusivity value of the heat transport layer 26, the thermal conductivity k and thermal capacity $TC=\rho*C_p$ (in $J/m^3K$) of the heat transport layer 26 were varied independently of each other to show their effects on fusing performance. The other parameters remained the same as those appearing in Table 1. It is desired to find an acceptable range of effusivity of the heat transport layer 26 that provides a temperature of at least 125 degrees C. at the toner-paper interface.

Figure 4:
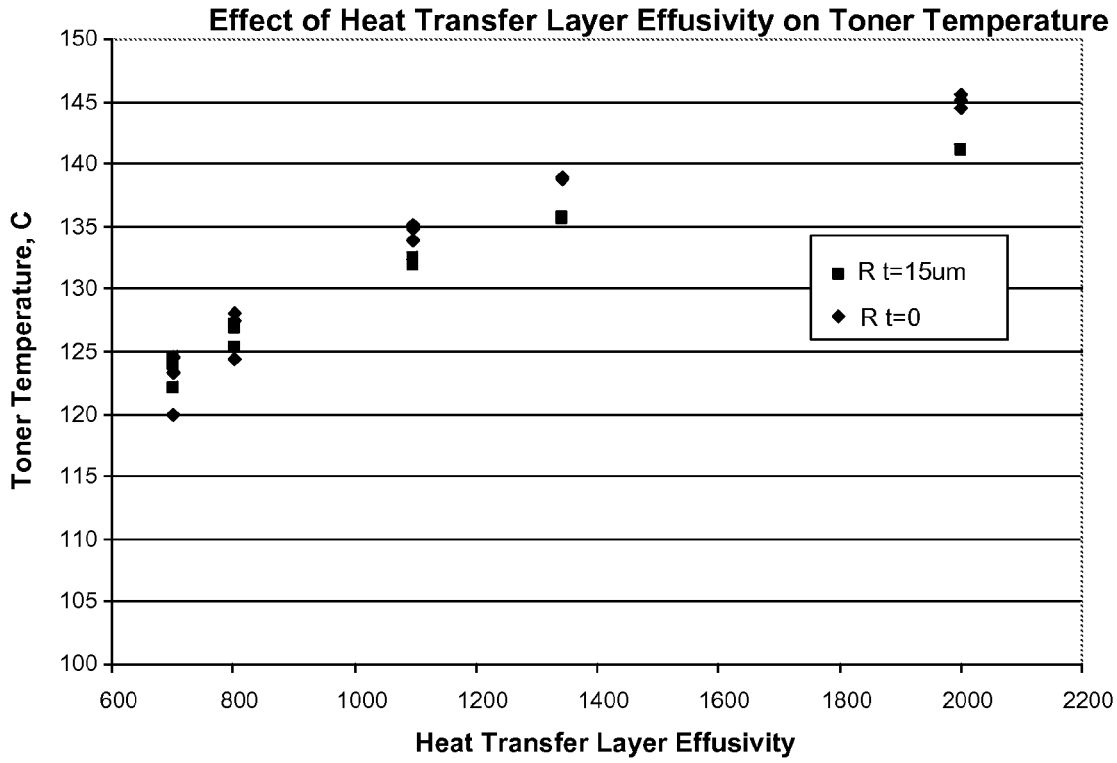
FIG. 4 is a graph illustrating a relationship between the effusivity value of heat transfer layer of the fusing member of FIG. 1 and its effect on toner temperature according to an exemplary embodiment.

The results in Table 2 and the graph of FIG. 4 show that with or without the release layer 28, i.e., the thickness of the release layer R either being zero or 0.015 mm, the thermal conductivity k or the thermal capacity TC of the heat transport layer 26 alone is not a good parameter to determine acceptable fusing performance. For example, a heat transport layer 26 having a relatively high thermal capacity TC but with a relatively low thermal conductivity k is seen to insufficiently transfer stored energy, whereas a heat transport layer 26 having a relatively high thermal conductivity k and a relatively low thermal capacity TC does is seen to have an insufficient amount of energy to transfer. Table 2 illustrates the acceptable values of the effusivity E of the heat transport layer 26 (HT). Further experimental results indicate that an acceptable effusivity value of the heat transport layer 26 should be equal to or greater than about 800 (W√s/(m²K)), particularly in the range of about 800 (W√s/(m²K)) to about 5000 (W√s/(m²K)), and more particularly in the range of about 1000 (W√s/(m²K)) to about 5000 (W√s/(m²K)).

TABLE 2

| R Thickness (mm) | HT Thickness (nm) | HT k, W/m (K) | HT TC (J/m³ K) | HT E, (W√s/(m² K)) | Toner Temperature (C.) |
|---|---|---|---|---|---|
| 0 | 0.254 | 0.6899 | 1739125.0 | 1095.4 | 135.08 |
| 0 | 0.254 | 1.0349 | 1739125.0 | 1341.6 | 138.80 |
| 0 | 0.254 | 0.6899 | 2608687.5 | 1341.6 | 139.03 |
| 0 | 0.254 | 0.4600 | 2608687.5 | 1095.4 | 134.85 |
| 0 | 0.254 | 1.0349 | 1159603.7 | 1095.4 | 133.90 |
| 0 | 0.254 | 0.4600 | 1402520.2 | 803.2 | 128.01 |
| 0 | 0.254 | 0.6899 | 935200.4 | 803.2 | 127.41 |
| 0 | 0.254 | 1.0349 | 623280.0 | 803.2 | 124.43 |
| 0 | 0.254 | 0.4600 | 1065915.3 | 700.2 | 124.52 |
| 0 | 0.254 | 0.6899 | 710797.2 | 700.2 | 123.34 |
| 0 | 0.254 | 1.0349 | 473490.8 | 700.2 | 119.88 |
| 0 | 0.254 | 0.4600 | 8695624.9 | 2000 | 144.42 |
| 0 | 0.254 | 0.6899 | 5795213.3 | 2000 | 145.09 |
| 0 | 0.254 | 1.0349 | 3864784.5 | 2000 | 145.53 |
| 0.0152 | 0.254 | 0.6899 | 1739125.0 | 1095.4 | 132.51 |
| 0.0152 | 0.254 | 1.0349 | 1739125.0 | 1341.6 | 135.55 |
| 0.0152 | 0.254 | 0.6899 | 2608687.5 | 1341.6 | 135.73 |
| 0.0152 | 0.254 | 0.4600 | 2608687.5 | 1095.4 | 132.54 |
| 0.0152 | 0.254 | 1.0349 | 1159603.7 | 1095.4 | 131.93 |
| 0.0152 | 0.254 | 0.4600 | 1402520.2 | 803.2 | 127.11 |
| 0.0152 | 0.254 | 0.6899 | 935200.4 | 803.2 | 126.81 |
| 0.0152 | 0.254 | 1.0349 | 623280.0 | 803.2 | 125.27 |
| 0.0152 | 0.254 | 0.4600 | 1065915.3 | 700.2 | 124.51 |
| 0.0152 | 0.254 | 0.6899 | 710797.2 | 700.2 | 123.96 |
| 0.0152 | 0.254 | 1.0349 | 473490.8 | 700.2 | 122.10 |

TABLE 2-continued

| R Thickness (mm) | HT Thickness (nm) | HT k, W/m (K) | HT TC (J/m³ K) | HT E, (W√s/(m² K)) | Toner Temperature (C.) |
|---|---|---|---|---|---|
| 0.0152 | 0.254 | 0.4600 | 8695624.9 | 2000 | 141.10 |
| 0.0152 | 0.254 | 0.6899 | 5795213.3 | 2000 | 141.09 |
| 0.0152 | 0.254 | 1.0349 | 3864784.5 | 2000 | 141.09 |

Figure 5:
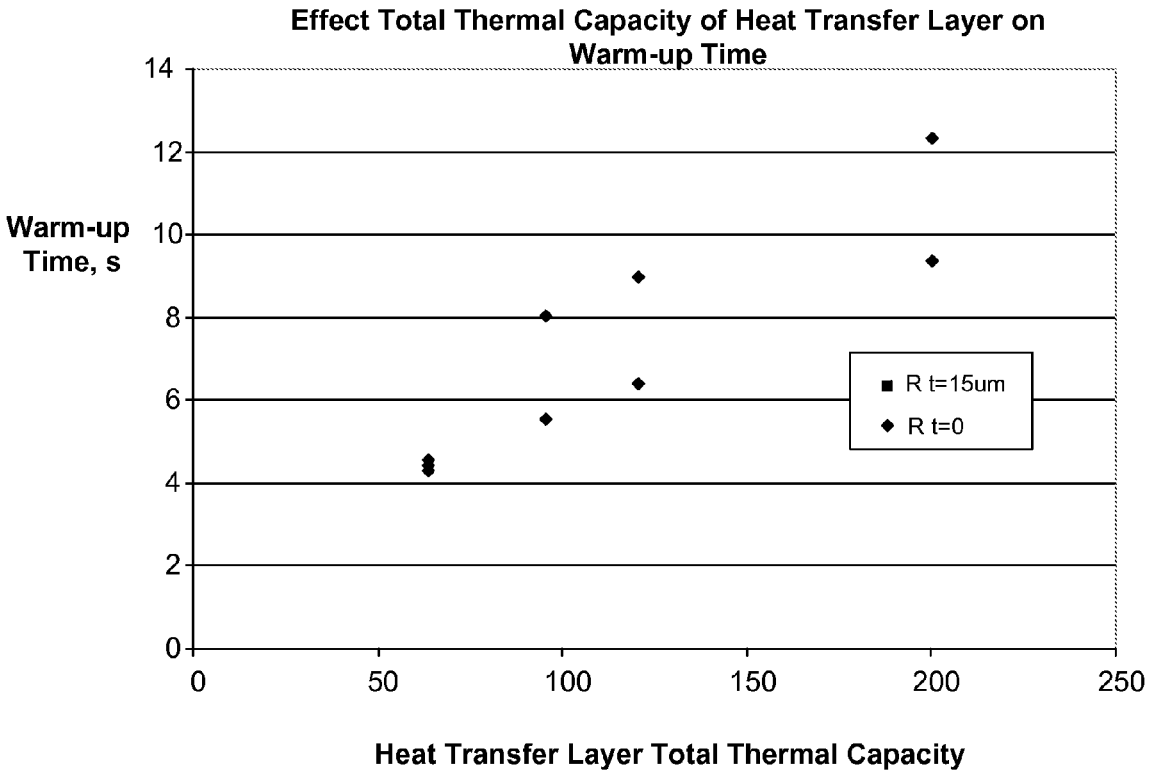
FIG. 5 is a graph illustrating a relationship between the total thermal capacity of the heat transfer layer of the fusing member of FIG. 1 and desired warm-up times according to an exemplary embodiment.

FIG. 5 illustrates the material properties of heat transport layer 26 versus fuser warm-up time. The total thermal capacity (TTC) of the heat transport layer 26 was determined using a 226 mm long fuser member 12 externally heated by a 1200 W external heater 20 from 20° C. to 200° C. The values of the parameters of Heat Transport layer (HT) 24, such as its thickness, diameter d, conductivity k, thermal conductivity TC, and effusivity value E of the heat insulation elastic layer (IE) 24, which were used to determine an acceptable total thermal capacity (TTC), are listed in Table 3. The thickness of the release layer (R) 28 used in the determination was 0.0152 mm.

The total thermal capacity (TTC) used in the experiment is defined as $TTC=\rho*C_p*t*d*\pi$, where ρ is the density, $C_p$ is the specific heat capacity, t is the thickness and d is the diameter of the heat transport layer (HT) 26 in mm. The experimental results shown in Table 3 illustrate that a total thermal capacity TTC of the heat transport layer (HT) 26 that ranges from about 63 to about 96 J/m K gives very good warm-up times, mostly less than 4.6 seconds. Further experimental results yielded that the total thermal capacity of the heat transport layer (HT) 26 may be in the range from about 1 to about 200 J/m K, and more particularly from about 1 to about 120 J/m K.

TABLE 3

| HT Thickness (mm) | HT diameter (mm) | HT k (W/m K) | HT TC (J/m³ K) | HT TTC (J/m K) | EI Thickness (mm) | EI E (W√s/(m² K)) | Warm-up time (sec) |
|---|---|---|---|---|---|---|---|
| 0.254 | 46 | 0.6899 | 1739125 | 63.837 | 3.048 | 292.25 | 4.428 |
| 0.381 | 46 | 0.6899 | 1739125 | 95.755 | 3.048 | 292.25 | 5.555 |
| 0.254 | 69 | 0.6899 | 1739125 | 95.755 | 3.048 | 292.25 | 8.022 |
| 0.254 | 46 | 1.0349 | 1739125 | 63.837 | 3.048 | 292.25 | 4.532 |
| 0.381 | 46 | 0.6899 | 1159604 | 63.847 | 3.048 | 292.25 | 4.276 |
| 0.480 | 46 | 0.6899 | 1739125 | 120.652 | 3.048 | 292.25 | 6.381 |
| 0.320 | 69 | 0.6899 | 1739125 | 120.652 | 3.048 | 292.25 | 8.987 |
| 0.480 | 46 | 0.6899 | 2883581 | 200.049 | 3.048 | 292.25 | 9.357 |
| 0.320 | 69 | 0.6899 | 2883581 | 200.049 | 3.048 | 292.25 | 12.309 |

Table 4 illustrates the results of the effect of the effusivity value of the heat insulation elastic layer (IE) 24 on fuser warm-up time (in seconds) based on the parameter settings. The parameters of the heat transport layer (HT) 24 are also shown in Table 4. The parameters such as thickness, thermal conductivity k, thermal capacity TC of the Heat Insulation Elastic Layer (IE) 26 are detailed below in Table 4.

TABLE 4

| HT Thickness (mm) | HT diameter (mm) | HT k (W/m K) | HT E (W√s/(m² K)) | IE Thickness (mm) | IE k (W/m K) | IE TC (J/m³ K) | IE E (W√s/(m² K)) | Warm-up time (sec) |
|---|---|---|---|---|---|---|---|---|
| 0.254 | 46 | 0.6899 | 1095.40 | 3.048 | 0.1159 | 737231 | 292.25 | 4.428 |
| 0.254 | 46 | 0.6899 | 1095.40 | 3.048 | 0.1738 | 737231 | 357.94 | 5.164 |
| 0.254 | 46 | 0.6899 | 1095.40 | 3.048 | 0.1159 | 1105846 | 357.94 | 5.164 |
| 0.254 | 46 | 0.6899 | 1095.40 | 3.048 | 0.0772 | 1105846 | 292.25 | 4.428 |
| 0.254 | 46 | 0.6899 | 1095.40 | 3.048 | 0.1738 | 491567 | 292.25 | 4.429 |

The results as shown Table 4 indicate that the effusivity E of the heat insulation elastic layer (IE) 24 is at an acceptable value in the range of about 292 to about 358 yield acceptable warm-up times. Further experiment results showed that the effusivity (E) value of the heat insulation layer (IE) should be less than about 400 W√s/(m$^2$K), and particularly in the range of about 100 to about 400 W√s/(m$^2$K), for an acceptable warm-up time of less than about six seconds.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A fuser member of an image forming device for fusing toner onto a substrate, comprising:

a core member comprising a rigid outer surface;

a heat insulation layer; and a heat transport layer;

wherein the heat transport layer has a thickness between about 0.25 and about 1.0 mm and a total thermal capacity between about 63 and about 200 J/m K, and the heat insulation layer has an effusivity value between about 100 and about 400 W√s/(m$^2$K).

2. The fuser member of claim 1, wherein the heat transport layer has an effusivity value between about 800 and about 5000 W√s/(m$^2$K).

3. The fuser member of claim 1, wherein the heat transport layer has an effusivity value between about 1000 and about 5000 W√s/(m$^2$K).

4. The fuser member of claim 1, wherein the total thermal capacity of the heat transport layer is between about 63 and about 96 J/m K.

5. The fuser member of claim 1, wherein the effusivity of the heat insulation layer is between about 292 and about 358 W√s/(m$^2$K).

6. The fuser member of claim 1, wherein the thickness of the heat transport layer is between about 0.25 mm and about 0.5 mm.

7. The fuser member of claim 1, wherein the effusivity value of the heat insulation layer is less than an effusivity value of the heat transport layer.

8. An image fixing apparatus for fixing a developed image on a recording medium, the image fixing apparatus including:

a backup device;

a fuser roller which forms a fixing nip portion with the backup device, the fuser roller comprising:

a rigid metal core member;

a heat insulation layer; and a heat transport layer; and a heater external to the fuser roller and disposed in proximity therewith;

wherein the heat transport layer has a thickness ranging from about 0.25 to about 1.00 mm and a total thermal capacity ranging from about 63 to about 96 J/m K, and the heat insulation layer has an effusivity value of about 100 to about 400 W√s/(m$^2$K).

9. The image fixing apparatus of claim 8, wherein the heat transport layer has an effusivity value between about 800 and about 5000 W√s/(m$^2$K).

10. The image fixing apparatus of claim 8, wherein the heat transport layer has an effusivity value between about 1000 and about 5000 W√s/(m$^2$K).

11. The image fixing apparatus of claim 8, wherein the effusivity of the heat insulation layer is between about 292 and about 358 W√s/(m$^2$K).

12. The image fixing apparatus of claim 8, wherein the effusivity value of the heat insulation layer is less than an effusivity value of the heat transport layer.

13. A fuser member, comprising:

a core member comprising a rigid outer surface;

a heat insulation layer; and a heat transport layer;

wherein the heat transport layer has a thickness of about 0.25 to about 1.0 mm and an effusivity between about 800 to about 5000 W√s/(m$^2$K), and the heat insulation layer has an effusivity value between about 100 and about 400 W√s/(m$^2$K).

14. The fuser member of claim 13, wherein the heat transport layer has a total thermal capacity of about 1 to about 200 J/m K.

15. The fuser member of claim 13, wherein the heat transport layer has a total thermal capacity of about 1 to about 120 J/mK.

16. The fuser member of claim 13, wherein the heat transport layer has a total thermal capacity of about 63 to about 96 J/mK.

17. The fuser member of claim 13, wherein the thickness of the heat transport layer is between about 0.25 mm and about 0.5 mm.

18. The fuser member of claim 13, wherein the effusivity of the heat transport layer is between about 1000 and about 5000 W√s/(m$^2$K).

19. The fuser member of claim 13, wherein the effusivity of the heat insulation layer is between about 292 and about 358 W√s/(m$^2$K).

* * * * *